US005225051A

United States Patent [19]

Poa et al.

[11] Patent Number: 5,225,051

[45] Date of Patent: Jul. 6, 1993

[54] ELECTROWINNING PROCESS WITH ELECTRODE COMPARTMENT TO AVOID CONTAMINATION OF ELECTROLYTE

[75] Inventors: Davis S. Poa; R. Dean Pierce, both of Naperville; Thomas P. Mulcahey; Gerald K. Johnson, both of Downers Grove, all of Ill.

[73] Assignee: The United States of America as represented by the United States Department of Energy, Washington, D.C.

[21] Appl. No.: 764,760

[22] Filed: Sep. 24, 1991

[51] Int. Cl.[5] ..... C25C 3/02; C25C 7/00; C25C 7/04

[52] U.S. Cl. ..... 204/64 R; 204/67; 204/69; 204/130; 204/243 R; 204/252; 204/294; 204/295

[58] Field of Search ..... 204/67-71, 204/243 R-247, 295, 64 R, 130, 252, 294

[56] References Cited

U.S. PATENT DOCUMENTS

| | | | |
|---|---|---|---|
| 2,913,382 | 11/1959 | Everts | 204/69 |
| 4,214,955 | 7/1980 | Bowman | 204/69 X |
| 4,225,401 | 9/1980 | Divisek et al. | 204/295 X |
| 4,409,083 | 10/1983 | Upperman et al. | 204/295 X |
| 4,988,417 | 1/1991 | DeYoung | 204/295 X |

*Primary Examiner*—Donald R. Valentine
*Attorney, Agent, or Firm*—James W. Weinberger; Robert J. Fisher; William R. Moser

[57] ABSTRACT

An electrolytic process and apparatus for reducing calcium oxide in a molten electrolyte of $CaCl_2$-$CaF_2$ with a graphite anode in which particles or other contamination from the anode is restricted by the use of a porous barrier in the form of a basket surrounding the anode which may be removed from the electrolyte to burn the graphite particles, and wherein the calcium oxide feed is introduced to the anode compartment to increase the oxygen ion concentration at the anode.

14 Claims, 4 Drawing Sheets

CELL CURRENT AND VOLTAGE VS. TIME

CELL CURRENT AND VOLTAGE VS. TIME

ELECTROWINNING PROCESS WITH ELECTRODE COMPARTMENT TO AVOID CONTAMINATION OF ELECTROLYTE

CONTRACTUAL ORIGIN OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

This invention relates to an electrolytic process and apparatus where the performance of an electrolyte is maintained by limiting electrode-derived contamination formed during the process and more particularly to a process and apparatus including an electrode compartment to restrict the electrode-derived contamination from adversely effecting the bulk electrolyte and cathode materials. The invention further relates to a process and apparatus using the electrode compartment where the feed is introduced into the compartment to improve the efficiency of the process.

Electrolytes of special importance are those used in the electrolytic reduction of metal oxides where the reaction of oxide ions at the anode results in liberation of CO and $CO_2$ and may result in the physical separation of particles from the anode. Usually the electrolytes are molten inorganic salts with the anode being carbon (often graphite). During operation of the process, particles of carbon separated from the anode float to the electrolyte surface. In the aluminum refining industry, skimming devices have been used to remove these particles because they may electrically short the cell or otherwise adversely affect the electrical performance of the cell.

The problem is also evident in other electrolytic processes involving the recovery or reusable metals from radioactive metal oxide compositions. One such process at a developmental stage involves the electrolytic reduction of calcium oxide in a $CaCl_2$-$CaF_2$ electrolyte where the anode is a consumable carbon electrode and the cathode is a molten metal pool such as Cu-Mg or Zn. The electrolytic process is part of an overall chemical process where the calcium and clean electrolyte regenerated in the electrolytic process are utilized to reduce uranium oxide, transuranium (TRU) element oxides, and fission product oxides in spent reactor fuel. The reduced TRU elements may be used as a fuel for a fast reactor, and the uranium may be stored for ultimate use as a fertile blanket material in a fast reactor. In the chemical reduction process, the calcium is converted to calcium oxide which becomes dissolved in the $CaCl_2$-$CaF_2$ salt and is recycled to the electrolytic process.

During operation of the process to recover elemental calcium and salts, carbon particles from the anode contaminate the electrolyte and may interfere with the operation of the electrolytic process by causing shorting. These particles may also react with cathode material in the cell or with fuel material if transferred with the electrolyte into the reduction step. Accordingly, one object of the invention is an improved electrolytic process and associated apparatus. A second object of the invention is the development of associated apparatus and process to limit electrode-derived contamination of the electrolyte in an electrolytic process. Another object of the invention is apparatus and associated electrolytic process to maintain the performance of the electrolyte in the process. An additional object of the invention is apparatus and associated electrolytic process to limit adverse reaction between electrode-derived contaminates and materials in the electrolyte. A further object of the invention is an improved process and apparatus for reducing a metal oxide. These and other objects will become apparent from the following detailed description.

SUMMARY OF THE INVENTION

This invention relates to an electrolytic process and associated apparatus in which an electrode-derived material normally separates from the electrode during the process and would limit the performance of the process and in which a chemically inert barrier in the electrolyte is provided about the electrode to form an electrode compartment and restrict the contamination of the electrolyte. The compartment wall must be sufficiently porous to allow the desired electrolytic transport while forming a barrier to the transfer of the separated electrode material. Also, the compartment is advantageously provided as a removable porous basket which contains a suspended anode with the basket and anode being periodically withdrawn from the cell. During this step, the electrolyte in the basket drains through the pores while the carbon particles or other contaminate are retained in the basket and may be subsequently removed by burning. The pore size of the compartment wall is sufficiently small to prevent carbon particles from moving through the pores yet sufficiently large to allow transfer of the salt. Suitably, the compartment wall is composed of porous magnesia with a pore size ranging from values in the order of 0.3 μm to 35 μm and preferably from about 0.3 μm to 20 μm. In some instances, the basket may be inserted even into the liquid metal cathode with the pore size being sufficiently small to avoid inward flow of metal.

The invention also relates to an electrolytic process and associated apparatus for reducing a metal oxide using a porous barrier where the metal oxide feed is introduced at the anode compartment to improve efficiency of operation. This has special importance where the anions of the salt electrolyte differ from the oxygen ion while the cations of the salt are primarily the same as the metal of the oxide.

DETAILED DESCRIPTION OF THE PREFERRED EMBODIMENT

Figure 1:
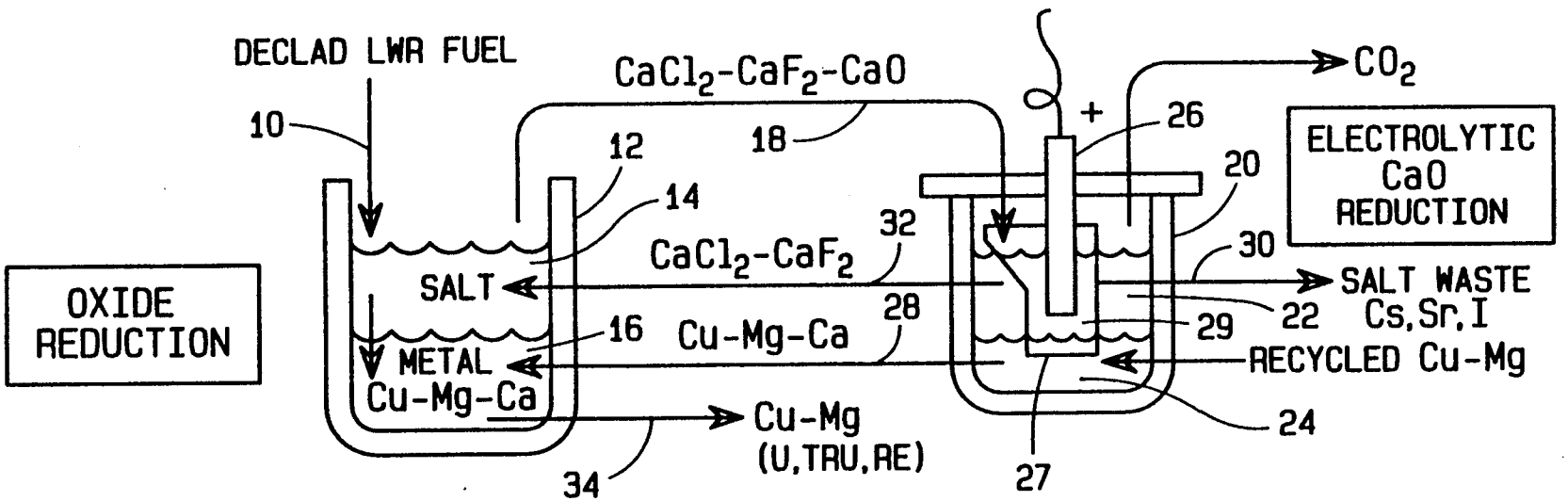
FIG. 1 is a sketch of a fuel recovery system utilizing electrolytic process for reclaiming elemental calcium and salts for recycle in the recovery or TRU elements and uranium from spent light water reactor ($UO_2$) fuel.

FIG. 1 is a sketch of a chemical process without the invention for recovering TRU elements and uranium from spent reactor fuel containing the oxides of uranium, transuranic elements, and fission products. As illustrated, a declad LWR (light water reactor) fuel is fed by line 10 to vessel 12 containing a $CaCl_2$-$CaF_2$ salt 14 over a liquid Cu-Mg mixture 16 containing Ca. Typically, the salt is composed of about 15 wt. % $CaF_2$ and 85 wt. % $CaCl_2$ with the Cu-Mg mixture containing about 65 wt. % of Cu and 35 wt. % of Mg. Contact between Ca and the metal oxides results in an exchange reaction to form CaO and the reduced metals (except for Cs, Sr and I). A portion of the salt containing CaO is transferred by line 18 to cell 20 containing the $CaCl_2$-$CaF_2$ salt 22 as an electrolyte over a liquid Cu-Mg cathode 24. Cell 20 also includes a graphite anode 26 extending into salt 22 and mounted within porous basket 27 of MgO to form an anode compartment 29. As illustrated, the $CaCl_2$-$CaF_2$-CaO is fed into the compartment 29 to provide a high concentration of oxygen ions adjacent the anode. During the electrolytic operation of the cell, CaO is reduced to Ca with the oxygen ion being transferred to the anode and forming $CO_2$. The Ca is dissolved in the Cu-Mg with a portion of the mixture being transferred to vessel 12 by line 28. A portion of the salt containing Cs and Sr (as halides) and I is removed by line 30 to waste. A portion of the salt in which CaO has been removed is returned to vessel 12 by line 32. The mixture of reduced metals in Cu-Mg (solvent metal) is removed by line 34 and subsequently treated (not shown) to separate uranium from the TRU elements and rare earth fission products.

As indicated previously, the consumable anode during operation of the process becomes a source of contamination in the form of carbon particles or flakes which tend to float on the electrolyte. In some instances, the carbon particles may cause electrical shorting of the cell or a partial shorting to reduce the voltage or cause significant variations in voltage within the cell. The contamination may also be a problem in processes containing certain metals such as uranium or TRU elements which may react with the carbon to form carbides.

Figure 2:
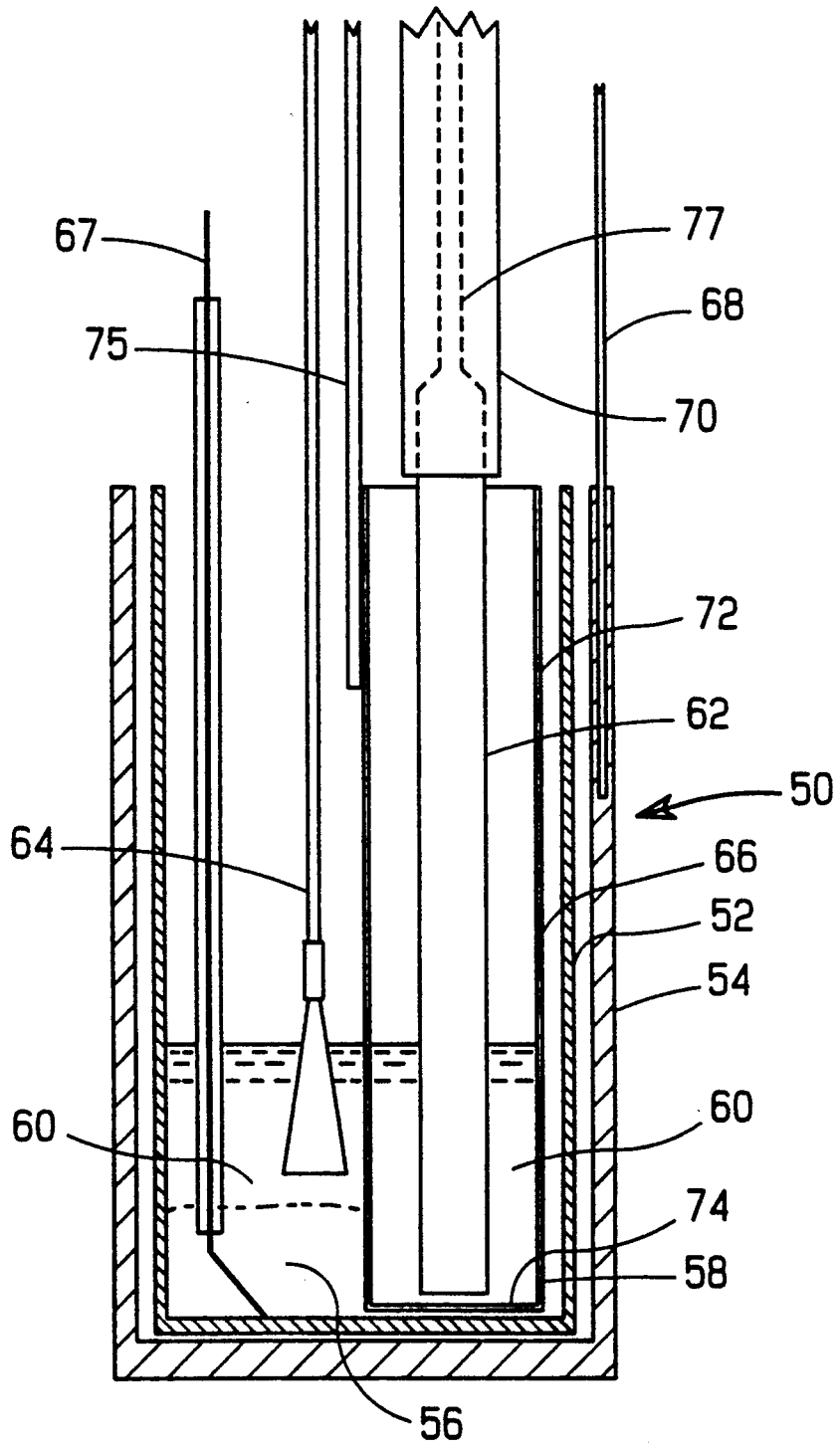
FIG. 2 is an enlarged side view of a sketch of a cell as one embodiment of the invention.

FIG. 2 represents an enlarged view of an experimental cell 50 as an embodiment of the invention. As illustrated, cell 50 includes a magnesia crucible 52 as the cell housing with a graphite outer container 54 as a graphite secondary, a liquid Cu-Mg (or zinc) cathode 56 at the lower extremity 58 of the magnesia housing, an electrolyte 60 of $CaCl_2$-$CaF_2$ with dissolved CaO which is molten at the operating temperature in the order of 800° C., a carbon or graphite rod anode 62 inserted into the electrolyte, a tungsten stirrer 64, a porous magnesia barrier 66 positioned about the anode 62 to form a compartment, and various accessories including connections 77 and 67 for a voltage source, a thermocouple 68, and anode insulation 70.

As illustrated, the magnesia barrier 66 is in the form of a basket 72 with a bottom 74 so that the basket 72 and anode 62 may be raised periodically by handle 75 or other basket removal means from the electrolyte and the anode removed from the basket. The porosity is controlled so that the electrolyte within the basket drains out leaving the carbon contamination which may be oxidized permitting reuse of the basket. Suitably, the porosity of the barrier is about 0.3 to 35 μm and preferably about 0.8 to 20 μm with the lower limit allowing transfer of calcium and oxygen ions. The upper limit of porosity is selected to restrict transferring the physical contaminant. This porosity also allows the barrier to extend into the liquid metal cathode because the pores are sufficiently small to prevent entry of the liquid metal into the confined zone.

While FIG. 2 is directed to the reduction of CaO, the process may be carried out for the reduction of other metal oxides such as aluminum, uranium, plutonium and the like. The electrolyte is a mixture of salts molten at elevated temperatures above about 350° C. and usually contains one or more metal halides of alkaline earth and for alkali metals such as Ca, Li, K, Wa, and the like. Preferably, the electrolyte is a mixture of metal halides with the electrolyte being molten at temperatures in the range of about 700°-900° C. Advantageously, the electrolyte is primarily composed of one or more halides of the same metal as the metal as the oxide. It is further advantageous to add the metal oxide to the anode compartment preferably in combination with the salt to avoid transfer of the oxygen ion across the porous barrier in competition with the halide ions. The selection of metal halides with the same metal as the metal of the oxide provides sufficient metal ions in the bulk of the electrolyte to provide an efficient process. With other metal oxides such as $Al_2O_3$ and $UO_2$, the electrolyte is composed of a major amount of alkali metal halides with a small amount of $AlF_3$ for the $Al_2O_3$ electrolyte or $UF_4$ for the $UO_2$ electrolyte.

The porous barrier is formed by a material essentially inert in the process. Refractory materials such as MgO, ALN, TiC, TiN, TaC or the like may be used.

Advantageously, the anode compartment is sized to isolate an anode zone containing electrolyte from the remainder of the electrolyte to avoid undesired contamination. Usually about 20 to 90% of the electrolyte is within the anode zone. The higher volumes within the compartment are useful to produce lower concentrations of oxide in the final salt product resulting from operation of the cell. With respect to the reduction of CaO, it is also preferred to have the anode zone sized to permit adding the $CaCl_2$-$CaF_2$-CaO into this zone. Clean salt is recovered from the zone on the side of the barrier opposite the anode. The salt from the anode side of the barrier filters into this cathode-side zone as the $CaCl_2$-$CaF_2$-CaO is added and when the anode compartment is raised. With the electrolyte composed of only calcium salts, calcium ions are readily available at the cathode. The calcium oxide is charged to the anode compartment; therefore, a high oxygen ion concentration is provided at the anode. Preferably the barrier is composed of an inert dielectric material of magnesium oxide with a pore size up to about 0.3 to 20 μm microns and has a wall thickness in the order of 1.5 mm. Present cells are approximately 90 mm in diameter with an anode compartment approximately 60 mm in diameter. With the porous barrier, the process may be carried out four times in the order of 54 hours without a problem. Subsequently, the basket formed by the barrier may be removed during which contained electrolyte drains through the pores into the main body of electrolyte while the carbon particles are retained in the basket. The carbon particles may be subsequently oxidized in air at about 800° C. and the basket returned to the cell.

The following examples are provided for illustrative purposes and are not intended to be restrictive as to the scope of the invention:

EXAMPLE 1

A sketch of the cell apparatus, Example 1, used for these experiments is shown in FIG. 2. The cell housing or container was a high-density magnesia crucible having an inside diameter of about 90 mm, a depth of about 150 mm, and a wall thickness of 1.5 mm. The magnesia housing contained an anode compartment about 58 mm ID × 145 mm deep (a porous MgO crucible with a metallic handle), an electrolyte component of the electrodes, and a stirrer (tungsten plate, triangular shape). The cathode was a pool of liquid metal of Zn with a tungsten rod electric conductor. The anode was a 19 mm dia carbon or graphite rod. The cell was placed inside a graphite secondary container, which was then positioned in a furnace well in the floor of the glovebox. A calibrated Chromel-Alumel thermocouple was inserted in a hole in the wall of the graphite secondary.

Prior to an electrolysis experiment, the graphite secondary and anode rod were preheated and degassed in a vacuum furnace (AVS Model No. HMF12-12-12-1300 Horizontal Vacuum Furnace, Advanced Vacuum Systems, Inc., Ayer, Mass) at about 1000° C. The MgO crucible was preheated at 225° C. for about 16 h in air.

Initially, about 39 g of salt mixture ($CaCl_2$-15 wt % $CaF_2$) and 27.1 g of CaO were loaded into the anode compartment, and 208 g of salt mixture, 210 g of zinc metal for the cathode were added to the cell container in the space outside the anode compartment.

The loaded cell was heated to about 808° C. with the anode resting on the CaO within the barrier. After the metal and salts were molten, the cathode conductor rod or cathode contact lead was installed in the cell.

After about one and one-half hour on open circuit, electrolysis was initiated. The cell operated in a constant current (1.0 to 1.5 A) mode. The operating cell voltage varied in the range of 1.6 to 2.35 V. The current and potential-time curves were recorded during electrolysis. It was observed that the electrical resistance of the porous MgO anode compartment during electrolysis was insignificant and that the operating conditions were more stable than for experiments performed previously without a porous anode compartment. The cell voltage showed no oscillation and no intermittent cell circuit shorting during the entire period of electrolysis.

At the completion of the electrolysis, the graphite anode and the cathode conductor rod were withdrawn from the cell. The graphite anode showed appreciable reaction loss. Filtered samples of the molten zinc cathode alloy were taken and analyzed for calcium to show that calcium metal was produced. The porous MgO anode compartment was then raised above the molten salt level to let the salt drain out of the porous crucible into the cell container.

After the cell was cooled to room temperature, the cell components, the solidified salt phase, and the metal ingot were examined. Postelectrolysis examination revealed that a layer of black carbon dust was retained inside the anode compartment (the porous MgO crucible), and the top surface of the bulk salt in the cell container was shiny and clean.

The estimated current efficiency for this experiment was 75% based on the calcium content in the zinc metal phase, which was determined by chemical analyses of the filtered sample of zinc cathode (6.58 wt. %), and the integrated current (26.2 Ah). This current efficiency is consistent with that derived from the gain in weight of cathode alloy.

EXAMPLE 2

The setup and procedure used for this experiment were similar to those employed in Example 1 except that a Cu-Mg (about 65 wt. % Cu and 35 wt. % Mg) cathode was employed. The anode compartment was a porous MgO crucible having an inside diameter of about 63 mm, a depth of about 145 mm, and a wall thickness of about 3.2 mm.

Figure 3:
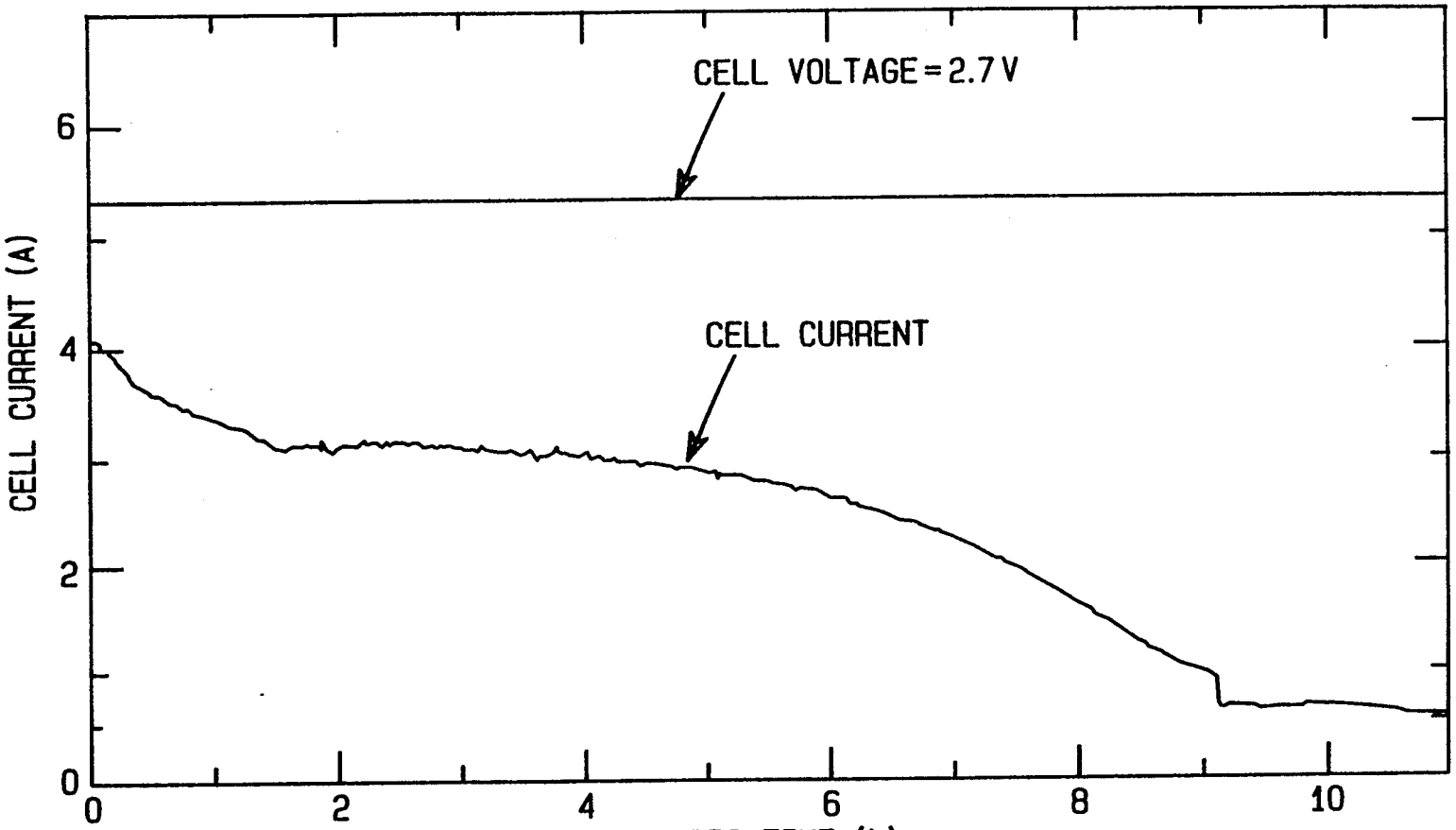
FIG. 3 is a graph showing cell current and voltage versus time for operation of a cell with the invention.

Initially, about 27.1 g CaO was loaded into the anode compartment with about 119 g copper, 63 g magnesium, 244.1 g $CaCl_2$, and 43.1 $CaF_2$ being added to the cell container in the space outside the anode compartment. The loaded cell was heated to about 801° C. After the metals and salts were molten, the graphite rod anode and the cathode conductor rod were installed in the cell. After about one-half hour on open circuit, electrolysis was initiated. The cell was operated in a constant voltage mode with the voltage control of the power supply being set at about 2.70 V. The initial cell current was about 4.0 A, which decreased continuously and smoothly with time of electrolysis, to about 0.6 A in 9 h, then, the current stabilized at 0.36 to 0.42 A for the remaining period (~35.5 h) of electrolysis. FIG. 3 shows the current- and the voltage-time curves recorded during the early period of electrolysis. The integrated current for this experiment was about 39 Ah, which was about 50% in excess of the theoretically required Ah for the electrolysis of the 27.1 g CaO.

At the conclusion of the experiment, a filtered sample of the liquid cathode alloy was taken for the determination of calcium. The porous MgO anode compartment was then raised above the molten salt level to let the salt drain out.

Postelectrolysis examination of the cell components revealed that the salt was completely drained out of the porous anode compartment. A large amount of black carbon dust was retained inside the compartment. The salt ingot recovered by the cell container was clear and clean. The top surface of the bulk salt ingot was clean and shiny. The current efficiency for this experiment was greater than 50%.

EXAMPLE 3

Figure 4:
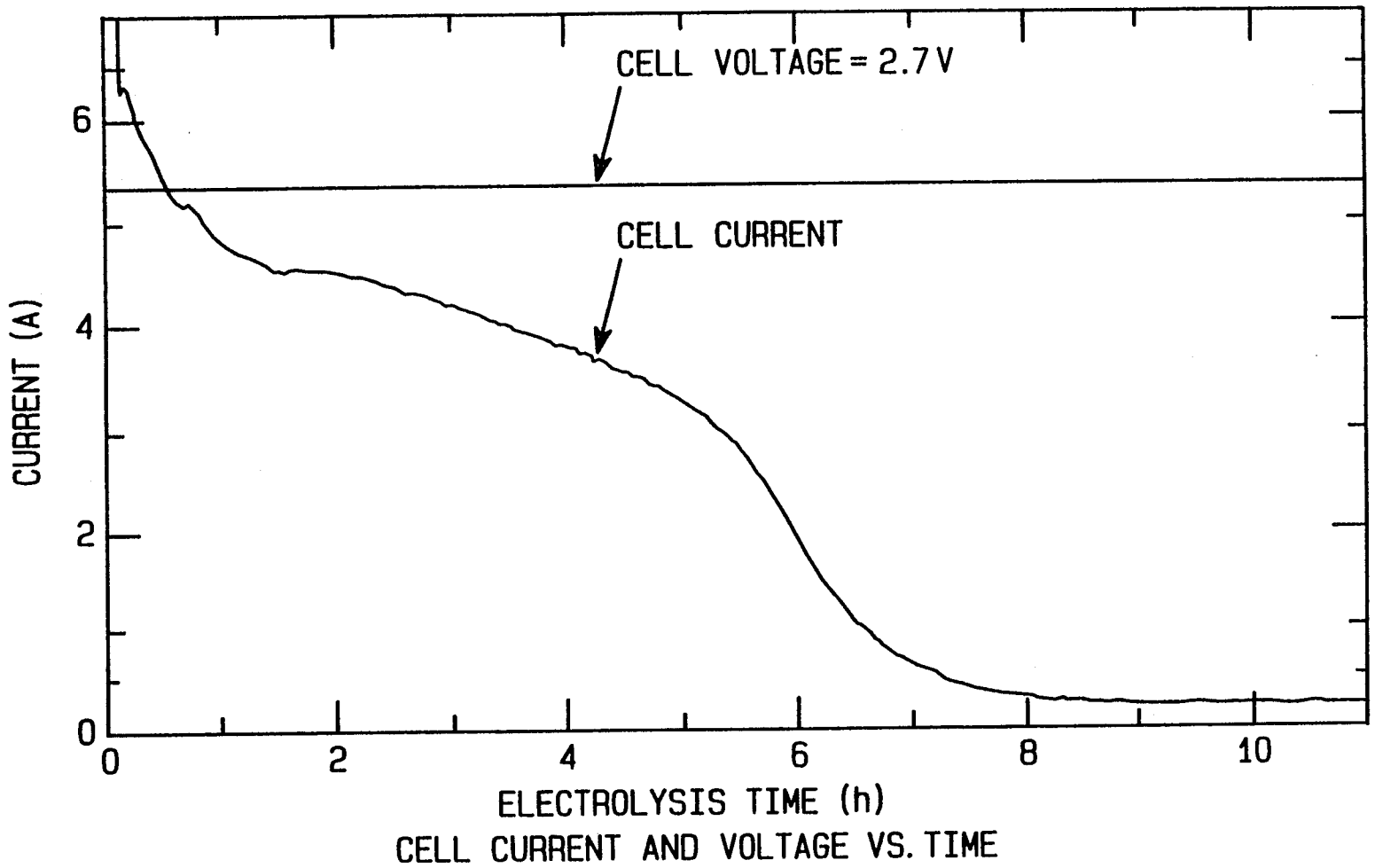
FIG. 4 is a graph showing cell current and voltage versus time for operation of another cell with the invention.

This experiment also was carried out to recover calcium and $CaCl_2$-$CaF_2$ salt from a salt containing oxide. In this experiment, a liquid Cu-35 wt. % Mg alloy pool was used as the cathode, which was made by initially loading about 63 g of magnesium and about 119 g of copper into the cell container in the space outside the anode compartment. The 422 g of reduction salt were added both inside and outside the anode compartment. The electrolysis was performed with a constant cell voltage of 2.70 V, and the cell temperature was about 804° to 806° C. The initial cell current was about 4.3 A. The current decreased to about 0.2 A in 9 h, then the cell current stabilized at about 0.1 A for the remaining period (about 37 h) of electrolysis. FIG. 4 shows part of the current and voltage-time curves recorded for this experiment.

The integrated current for this experiment was 24.25 Ah. The current efficiency for this experiment was 71% based on the calcium content in the cathode alloy (4.36 wt. %) plus the calculated additional calcium that had reacted with the MgO crucible (2.65 wt. %).

Post-electrolysis examination of the cell components revealed that the salt ingot was clean, and all the black carbon dust was retained inside the anode compartment. A burning test was made on the carbon dust, and the result showed that, at 800° C. in air, the burning of the black dusty materials was complete.

The foregoing description of embodiments of the invention has been presented for purposes of illustration and description. It is not intended to be exhaustive or to limit the invention to the precise form disclosed, and, obviously, many modifications and variations are possible in light of the above teaching.

The embodiments of this invention in which an exclusive property or privilege is claimed are defined as follows:

1. An electrolytic cell comprising a cell housing adapted to contain an electrolyte to a predetermined level, an anode and a cathode in the cell housing adapted to contact the electrolyte, one of the electrodes being a source of a contaminant as a separate phase in the electrolyte during operation of the cell, and a basket-shaped, barrier-like structure in the cell housing adjacent the one electrode, said structure extending from below the electrode to above the predetermined electrolyte level to define (and defining) an electrode compartment around that electrode, thereby isolating that electrode, the barrier-like structure being composed of a refractory having sufficient porosity to permit ion and/or electrolyte transfer while preventing contaminant transfer.

2. The cell of claim 1 wherein the one electrode is composed of carbon with the contaminant being carbon particles.

3. The cell of claim 2 wherein the refractory for the barrier-like structure is MgO, AlN, TiC, TiN, TaC or mixtures thereof.

4. The cell of claim 2 including means above the one electrode for removing the basket and one electrode from the electrolyte.

5. The cell of claim 4 wherein the electrolyte and porosity of the barrier-like structure are characterized by the electrolyte in said zone draining from the basket while the contaminant is retained in the basket for subsequent removal.

6. The cell of claim 5 including means for adding a metal oxide into the electrolyte zone between the barrier-like structure and the one electrode, the metal of the oxide being recovered at the second electrode.

7. The cell of claim 6 wherein the one electrode is an anode and composed of carbon, the contaminant is carbon particles, the barrier-like structure is a basket composed of magnesium oxide, the electrolyte is composed of one or more calcium halides, the metal oxide is calcium oxide and the cathode is a liquid metal pool below the electrolyte in the cell.

8. A process of electrolytically recovering a metal from an oxide of the metal comprising the steps of:

(a) providing an electrolytic cell including a molten salt electrolyte containing the metal oxide and one or more halide salts of the metal, a pair of spaced apart electrodes in the electrolyte, and a source of electrical voltage to the electrodes, one of the electrodes being an anode and a source of particulate carbon contamination of the electrolyte during operation of the cell, (b) operating the cell to recover the metal as an element at the other electrode while confining the contaminant to a zone in the electrolyte about the one electrode, and (c) periodically removing the contaminant from the electrolyte zone while interrupting operation of the cell.

9. The process of claim 8 wherein the cell includes a porous barrier to form the electrolyte zone and the process includes the step of adding the metal oxide to the electrolyte zone.

10. The process of claim 9 wherein the metal oxide is calcium oxide, the one electrode is carbon, and the contaminant is carbon particles.

11. The process of claim 8 including the step of adding the metal oxide to the electrolyte zone.

12. A process for electrolytically reducing a metal oxide comprising the steps of:

(a) providing an electrolytic cell including an electrolyte molten at temperatures in the range of about 700°–900° and composed of a mixture of alkaline earths selected from the group of oxides of of Ca, Al, U, and Pu, metal halides including the metal of the metal oxide, and an anode-cathode pair of electrodes separated in the cell and in contact with the electrolyte, (b) providing a porous barrier about the anode to form an anode compartment containing a portion of the electrolyte and allowing ionic transfer across the barrier, (c) adding the metal oxide to the compartment to increase the oxygen ion concentration in the compartment and facilitate transfer of the ion to the anode without transfer across the barrier, and (d) operating the cell to transfer oxygen ions to the anode and metal ions from the metal oxide and/or halide with the same metal to the cathode.

13. The process of claim 12 wherein the metal of the metal halides is the metal of the metal oxide.

14. The process of claim 13 wherein the metal oxide is calcium oxide.

* * * * *

UNITED STATES PATENT AND TRADEMARK OFFICE

CERTIFICATE OF CORRECTION

PATENT NO. : 5,225,051

DATED : July 6, 1993

INVENTOR(S) : David S. Poa, R. Dean Pierce, Thomas P. Mulcahey and Gerald K. Johnson.

It is certified that error appears in the above-indentified patent and that said Letters Patent is hereby corrected as shown below:

On the Title page, item [75] Inventors: Davis S. Poa; R. Dean Pierce, both of " should read --[75] Inventors: David S. Poa; R. Dean Pierce, both of--.

Signed and Sealed this

Second Day of May, 1995

Bruce Lehman

*Attest:*

BRUCE LEHMAN

*Attesting Officer*

*Commissioner of Patents and Trademarks*